United States Patent [19]

Isaacson et al.

[11] 3,975,863

[45] Aug. 24, 1976

[54] VIBRATORY APPARATUS AND METHOD

[75] Inventors: Max Isaacson; Benjamin Smilg, both of Dayton, Ohio

[73] Assignee: Vibrodyne, Inc., Dayton, Ohio

[22] Filed: Aug. 26, 1974

[21] Appl. No.: 500,354

[52] U.S. Cl. ..... 51/163.1; 51/313

[51] Int. Cl.[2] ..... B24B 31/06

[58] Field of Search ..... 51/163, 7, 313

[56] References Cited

UNITED STATES PATENTS

| | | | |
|---|---|---|---|
| 2,967,434 | 1/1961 | Mahlfeldt | 51/7 UX |
| 3,623,706 | 11/1971 | Issacson | 51/163 X |
| 3,643,384 | 2/1972 | Isaacson | 51/163 |

*Primary Examiner*—Harold D. Whitehead

*Attorney, Agent, or Firm*—Jacox & Meckstroth

[57] ABSTRACT

A plurality of generally cylindrical parallel tubs are arranged in horizontally adjacent relation and define corresponding chambers for receiving loads of parts and treating media. The tubs are rigidly connected and are supported by a set of springs to provide a neutrally statically stable tub system which oscillates at a predetermined resonant frequency on an axis extending substantially through the center of gravity of the tub system. Preferably, the oscillatory tub system is excited at substantially the resonate frequency by a set of electro-magnets which are arranged in opposng relation on opposite sides of an armature positioned below the tubs and within a vertical plane extending through the pivot axis. The springs may include a set of spring beams located at opposite ends of the tubs to provide the effective pivot axis and/or a set of coil springs which are located laterally outboard of the tubs and are positioned normally to a plane extending through the coincident pivot axis and center of gravity of the tub system.

8 Claims, 3 Drawing Figures

VIBRATORY APPARATUS AND METHOD

BACKGROUND OF THE INVENTION

In a vibratory machine or apparatus of the type generally disclosed in U.S. Pat. No. 3,173,664 which issued to the assignee of the present invention, it is desirable for the tub which receives the work load of parts and media, to have a center of pivotation or pivot axis located above and laterally offset with respect to the center of gravity of the work load within the tub. The pivotally supported tub has also been designed to have a high moment of inertia so that changes in the work load did not significantly affect the tuned natural frequency of the tub system. As disclosed in U.S. Pat. No. 3,643,384, which also issued to the assignee of the present invention, it was found desirable to apply the vibratory impulses at the center of percussion of the pivotally supported tub system and in a direction perpendicular to a line connecting the center of pivotation to the center of gravity. As a result, the pivot point will experience only a resultant torque and no linear shock forces.

The location of the center of gravity below the pivot axis, as shown in above U.S. Pat. No. 3,173,664, also provides for a tub which tends to be statically stable and affords the opportunity for the center of percussion to be located in line with the applied electromagnetic forces so that the linear shock loads on the spring beams and the supporting bolts are minimized. On the other hand, if the pivot axis was located below the center of gravity of the vibratory tub system, an increase in the work load undesirably increases the moment of inertia and also increases the instability of the system. The location of the pivot axis below the center of gravity also has an adverse effect on the location of the center of percussion and would require locating the electromagnetic drive above the tub system in order to minimize linear shock forces at the pivot axis.

SUMMARY OF THE INVENTION

The present invention is directed to an improved vibratory machine or apparatus for treating parts and the like and which has the important advantage of minimizing the moment of inertia of the vibratory or oscillatory components or tub system. This feature is provided by locating the center of gravity of the vibratory components or tub system substantially coincident with the pivot axis of the tub system. As a result, the apparatus is capable of handling significantly larger work loads with less stress on the components supporting the vibrating or oscillating system and with less energy required to vibrate or oscillate the system.

In accordance with one embodiment of the invention, the vibratory apparatus includes a set of two generally cylindrical adjacent containers or tubs which are rigidly connected as a unit and are supported by a set of srings, such as spring beams and/or coil springs, for oscillatory movement on an axis which extends substantially through the center of gravity of the tub system. Each tub is offset laterally with respect to the pivot axis to provide for effective orbital movement of the work load within each tub for obtaining effective treatment of the parts. In addition, the twin tub system and its support provide for a condition of static balance which minimizes the torsional stress on the spring beams.

Other features and advantages of the invention will be apparent from the following description, the accompanying drawing and the appended claims.

DESCRIPTION OF THE PREFERRED EMBODIMENT

Figure 1:
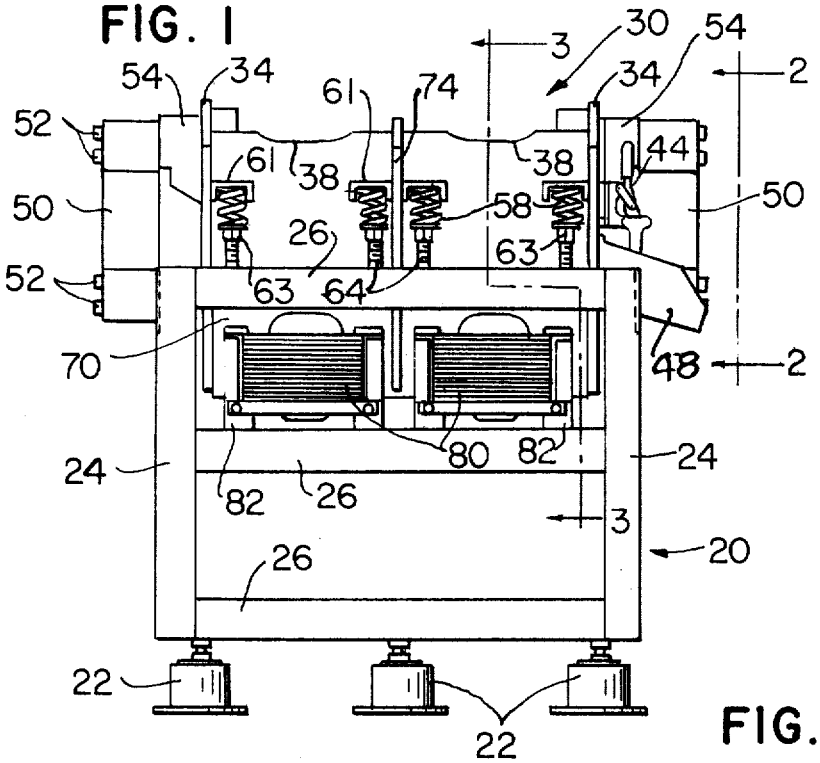
FIG. 1 is a side elevational view of a vibratory machine or apparatus constructed in accordance with the present invention.
Figure 2:
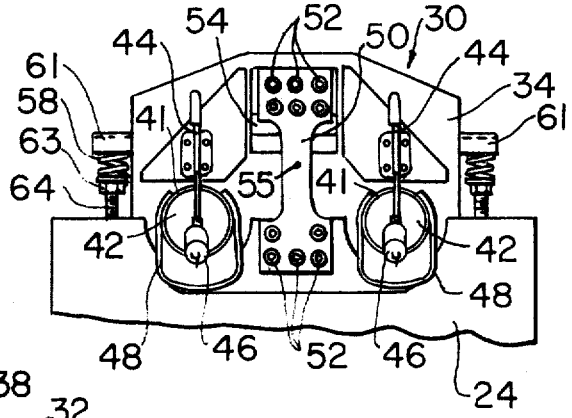
FIG. 2 is a fragmentary end view taken generally on the line 2—2 of FIG. 1.
Figure 3:
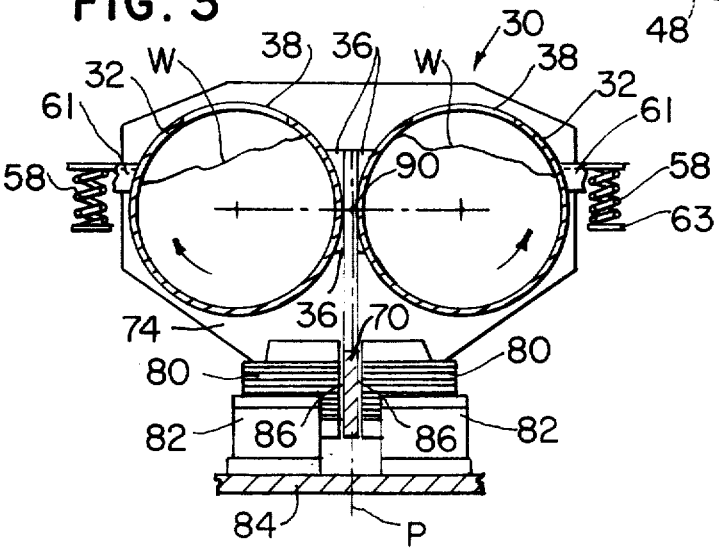
FIG. 3 is a fragmentary section taken generally on the line 3—3 of FIG. 1.

The vibratory finishing or treating apparatus shown in FIGS. 1 — 3 includes a fabricated metal base frame 20 which is mounted on a set of vibration absorbing support feet or pads 22. The frame 20 includes a set of end frame walls or plates 24 which are rigidly connected by a set of longitudinally extending frame members 26 extending along each side of the frame 20.

A vibratory or oscillatory tub system 30 is positioned between the end walls 24 of the frame 20 and includes a pair of substantially cylindrical tube-like containers or tubs 32 which are arranged in horizontally adjacent parallel relation. The ends of the tubs 32 are formed by parallel spaced common end plates 34, and the tubs are also rigidly connected by a set of blocks 36 (FIG. 3) spaced between the end plates 34. Each of the cylindrical tubs 32 has a set of longitudinally spaced circular top openings or inlets 38 for supplying a load of parts and treating media to each of the tubs.

A pair of circular openings (FIG. 2) are provided within one of the end plates 34 and define coresponding outlets for each of the tubs 32. A circular door member 42 is provided for each of the openings 41 and is carried by a corresponding hand actuated lever mechanism 44 between an open position (not shown) and a locked closed position (FIGS. 1 and 2). Each of the door members 42 is provided with a liquid drainage opening which is normally closed by a removable plug 46, and a U-shaped inclined chute 48 projects outwardly from each of the openings or outlets 41.

In the embodiment illustrated, the oscillatory tub system 30 is supported, in part, by a set of I-shaped spring beams 50 which are located at opposite ends of the tubs 32 outwardly from the end plates 34. The lower end portion of each spring beam 50 is rigidly secured by a set of screws or bolts 52 to the corresponding end walls 24 of the frame 20, and the upper end portion of each spring beam 50 is rigidly secured by another set of bolts 52 to a corresponding reinforcing mounting pad 54 welded to the adjacent end plate 34 of the tubs 32. The spring beams 50 provide the oscillatory system 30 with a virtual or effective pivot axis 55 which is midway between the ends of each spring beam 50.

In addition to the spring beams 50, the tub system 30 is supported for oscillatory movement by a set of coil compression springs 58 which engage corresponding channel-like support brackets 61 projecting outwardly from the sides of the tubs 32. The lower end portion of each spring 58 is supported by a net and washer assembly 63 which is adjustably mounted on a corresponding threaded rod or post 64 secured to the adjacent longitudinal frame member 26. By properly selecting the coil springs 58, to provide a substantially tuned system having a predetermined frequency, the twin tubs 32 may be effectively supported for oscillation on the effective pivot axis 55 and at the desired frequency without the use of the end spring beams 50. However, in most installations, the use of the spring beams 50 is desirable.

Referring to FIGS. 1 and 3, an elongated rectangular armature 70 extends longitudinally below the twin tubs 32 between the end walls or plates 34 so that it forms a rigid part of the oscillatory tub system 30. The armature 70 is located within a vertical reference plane P which extends midway between the two tubs 32. The center portion of the armature 70 is rigidly connected to the tubs 32 by an intermediate plate 74 which extends vertically midway between the parallel end plates 34.

The oscillatory tub system 30 which includes the twin tubs 32 and all components rigidly secured to the tubs, is adapted to be oscillated on the axis 55 by power operated means which include two longitudinally spaced pairs of electro-magnets 80 arranged in opposing relation on opposite sides of the armature 70. Each of the magnets 80 is mounted on a corresponding bracket 82 which is adjustably supported by a cross-plate 84 forming a part of the frame 20. Each of the magnets 80 is adjusted to form a predetermined uniform gap 86 between the armature 70 and each of the electro-magnets 80 according to the desired amplitude of oscillation.

As indicated above, the oscillatory tub system 30 including the rigidly connected tubs 32, the armature 70 and its support plates 34 and 74', and the doors 42, has a combined center of gravity 90 (FIG.3) which is located substantially on or coincident with the pivot axis 55 of the tub system 30. As a result of the center of gravity 90 being coincident with the effective pivot axis 55, the oscillatory tub system 30 has a minimum moment of inertia so that the minimum energy is required for operating the electro-magnets 80 to produce simultaneous orbital movement of the work load W within the tubs 32. It is also apparent that while the combined tubs 32 and corresponding work loads W have a center of gravity 90 disposed substantially on the pivot axis 55, the center of gravity of each work load W within the corresponding tub 32 is laterally offset relative to the pivot axis 55 to produce the effective orbital movement of the work load within each tub 32 as illustrated by the arrows in FIG. 3. By minimizing the moment of inertia, the stiffness of the spring beams 50 may be minimized, thereby significantly reducing the probability of fatigue failure of the spring beams and the attaching bolts 52. The symmetrical relationship of the tubs 32 with respect to the pivot axis 55 also provides for a counterbalancing effect of the tubs 32 and their respective work loads so that the static loads of the tubs 32 and their respective work loads do not produce torsional stresses on the spring beams 50 which define the effective pivot axis 55.

While the method and form of vibratory apparatus herein described constitute a preferred embodiment of the invention, it is to be understood that the invention is not limited to the precise method and form of apparatus described, and that changes may be made therein without departing from the scope and spirit of the invention as defined in the appended claims.

We claim:

1. Vibratory apparatus for treating parts and the like, comprising a frame, rigid tub means defining at least two treating chambers each adapted to receive a corresponding work load of parts and treating media, each of said treating chambers having a substantially horizontal center axis about which the corresponding work load orbits, spring means mounted on said frame and connected to said tub means, said tub means and said spring means forming a substantially tuned oscillatory tub system having a predetermined frequency and a predetermined center of gravity, said spring means supporting said tub system for oscillation on an effective pivot axis extending between said chambers and within a plane passing substantially through said center orbital axes of said chambers, said center of gravity of said tub system coinciding substantially with said effective pivot axis to produce a neutrally statically stable tub system and to minimize the moment of inertia of said tub system, and power operated means for oscillating said tub system on said effective pivot axis and at a frequency corresponding generally to the resonant frequency of said tub system when said chambers are loaded.

2. Vibratory apparatus as defined in claim 1 wherein said tub means comprise a plurality of tubs positioned in parallel adjacent relation and defining said treating chambers, and said spring means comprise a set of spring beams positioned at opposite ends of said tubs.

3. Vibratory apparatus as defined in claim 1 wherein said tub means comprise a plurality of tubs positioned in parallel adjacent relation, and said spring means comprise a set of coil springs positioned outboard of said tubs and substantially normal to said plane extending through said pivot axis.

4. Vibratory apparatus as defined in claim 1 wherein said tub means comprise a plurality of horizontally disposed and generally cylindrical parallel tubs.

5. Vibratory apparatus as defined in claim 4 wherein said power operated means for oscillating said tub system comprise an elongated armature positioned below said tubs and extending parallel to the axes of said tubs, and a set of electromagnets positioned in opposing relation on opposite sides of said armature.

6. Vibratory apparatus as defined in claim 5 wherein said set of electromagnets comprise a plurality of axially spaced pairs of electromagnets.

7. Vibratory apparatus for treating parts and the like, comprising a frame, rigid tub means defining at least two treating chambers disposed on opposite sides of a center plane of symmetry, each of said treating chambers being adapted to receive a corresponding work load of parts and treating media and having a substantially horizontal center axis about which the work load orbits, spring means mounted on said frame and connected to said tub means, said spring means supporting said tub system for oscillation on an effective pivot axis predetermined by the intersection of said plane of symmetry and a second plane passing substantially through said center axes about which the work loads orbit, said tub means and said spring means forming a substantially tuned oscillatory tub system having a predetermined natural frequency about said pivot axis, said tub system having a center of gravity coinciding substantially with said effective pivot axis to produce a neutrally statically stable tub system and to minimize the moment of inertia of said tub system, and power operated means for oscillating said tub system on said effective pivot axis and at a frequency corresponding generally to the resonant frequency of said tub system when said chambers are loaded.

8. In a method of treating a supply of parts within a media and including the steps of placing a plurality of work loads of the parts and media within a corresponding plurality of chambers of a rigid tub system having a predetermined center of gravity, supporting said tub system by spring means for oscillatory movement at a predetermined tuned natural frequency and on a generally horizontally extending effective pivot axis, and oscillating said tub system on said axis and at generally said frequency with power operated means to effect orbital movement of each work load within its corresponding said chamber about a generally horizontal center axis, the improvement comprising the step of arranging said tub system and said spring means to position said center of gravity of said tub system substantially on said effective pivot axis and within a plane passing substantially through said center orbital axes of said chambers to provide a neutrally statically stable tub system and for minimizing the moment of inertia of said tub system and the power required from said power operated means to oscillate said tub system in addition to minimizing the stresses on said tub system.

* * * * *